US007699031B2

(12) United States Patent
Smith et al.

(10) Patent No.: US 7,699,031 B2
(45) Date of Patent: Apr. 20, 2010

(54) TIMING PHASER WITH OFFSET SPOOL VALVE

(75) Inventors: Franklin R. Smith, Cortland, NY (US); Peter Chapman, Lecco (IT)

(73) Assignee: BorgWarner Inc., Auburn Hills, MI (US)

( * ) Notice: Subject to any disclaimer, the term of this patent is extended or adjusted under 35 U.S.C. 154(b) by 145 days.

(21) Appl. No.: 11/816,835

(22) PCT Filed: May 2, 2006

(86) PCT No.: PCT/US2006/016666

§ 371 (c)(1),
(2), (4) Date: Aug. 22, 2007

(87) PCT Pub. No.: WO2006/119210

PCT Pub. Date: Nov. 9, 2006

(65) Prior Publication Data

US 2008/0156284 A1 Jul. 3, 2008

Related U.S. Application Data

(60) Provisional application No. 60/676,822, filed on May 2, 2005.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.16, 90.17, 90.31
See application file for complete search history.

(56) References Cited

U.S. PATENT DOCUMENTS

| | | | | |
|---|---|---|---|---|
| 5,002,023 | A | 3/1991 | Butterfield et al. | |
| 5,046,460 | A | 9/1991 | Butterfield et al. | |
| 5,107,804 | A | 4/1992 | Becker et al. | |
| 5,172,659 | A | 12/1992 | Butterfield et al. | |
| 5,289,805 | A | 3/1994 | Quinn, Jr. et al. | |
| 5,797,363 | A | 8/1998 | Nakamura | |
| 6,085,708 | A * | 7/2000 | Trzmiel et al. | 123/90.17 |
| 6,196,174 | B1 | 3/2001 | Wada et al. | |
| 6,260,526 | B1 | 7/2001 | Kobayashi | |
| 6,263,846 | B1 * | 7/2001 | Simpson et al. | 123/90.17 |
| 6,302,071 | B1 * | 10/2001 | Kobayashi | 123/90.16 |
| 6,374,786 | B1 * | 4/2002 | Ogawa | 123/90.17 |
| 2005/0045130 | A1 * | 3/2005 | White et al. | 123/90.17 |

FOREIGN PATENT DOCUMENTS

| | | |
|---|---|---|
| DE | 4307010 | 10/1993 |
| DE | 10002352 | 8/2000 |
| EP | 0829621 | 3/1998 |
| EP | 0924393 | 6/1999 |

(Continued)

*Primary Examiner*—Zelalem Eshete
(74) *Attorney, Agent, or Firm*—Brown & Michaels, PC

(57) ABSTRACT

A variable cam timing phaser for an internal combustion engine with at least one camshaft includes a housing (144), a rotor (138), and a phaser control valve (168). The phase control valve is offset from a center axis of rotation through the camshaft of the phaser and may also be parallel to the center axis of rotation. The phaser control valve directs fluid flow to shift the relative angular position of the rotor relative to the housing. The phaser may be cam torque actuated, oil pressure actuated, or torsion assist.

14 Claims, 15 Drawing Sheets

FOREIGN PATENT DOCUMENTS

| | | |
|---|---|---|
| EP | 1081340 | 3/2001 |
| EP | 1111200 | 6/2001 |
| EP | 1113152 | 7/2001 |
| JP | 56031570 | 3/1981 |
| JP | 8061495 | 3/1996 |
| JP | 9264110 | 10/1997 |
| JP | 10213237 | 8/1998 |

* cited by examiner

TIMING PHASER WITH OFFSET SPOOL VALVE

REFERENCE TO RELATED APPLICATIONS

This application claims an invention which was disclosed in Provisional Application No. 60/676,822, filed May 2, 2005, entitled "TIMING PHASER WITH OFFSET SPOOL VALVE". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable cam timing systems. More particularly, the invention pertains to a variable cam timing phaser with an offset spool.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a housing with one or more vanes, mounted to the end of the camshaft, surrounded by a housing with the vane chambers into which the vanes fit. It is possible to have the vanes mounted to the housing, and the chambers in the housing, as well. The housing's outer circumference forms the sprocket, pulley or gear accepting drive force through a chain, belt or gears, usually from the camshaft, or possibly from another camshaft in a multiple-cam engine.

The spool valve of the variable cam timing phasers may be mounted externally from the phaser or internal to the phaser. The internally mounted spool valve may be center mounted and some of the limitations of center mounting of a spool are having to use a center bolt to mount the spool valve as shown in Butterfield et al.'s U.S. Pat. No. 5,046,460, mounting the spool valve in the camshaft end as in Butterfield et al.'s U.S. Pat. No. 5,002,023, or using a flange on the end of the camshaft to mount the spool valve as in Becker et al.'s U.S. Pat. No. 5,107,804.

An example of an internal center mounted spool in a variable cam timing (VCT) phaser is shown in prior art FIG. 1. The VCT phaser 22 is coupled to a camshaft by numerous bolts 36. The housing 40 of the phaser has an outer circumference or teeth 56 for accepting drive force from a chain 58. The rotor 38 is connected to the camshaft and is coaxially located within the housing 40. The rotor 38 has vanes 42, which separates chambers formed between the housing 40 and the rotor 38 into advance chambers 46 and retard chambers 48. The vanes 42 are capable of rotation to shift the relative angular position of the housing 40 and the rotor 38. Fluid is supplied to the phaser 22 through supply line 55 leading to the spool valve 50. Lines 52, 54, 60, supply fluid between the advance 46 and retard chambers 48 and the center mounted spool valve 50. Check valves 61 are present in line 54. The position of the spool within the spool valve 50 controls the motion, (e.g. to move towards the advance position or the retard position) of the phaser.

SUMMARY OF THE INVENTION

A variable cam timing phaser for an internal combustion engine with at least one camshaft includes a housing, a rotor, and a phase control valve. The phase control valve is offset from a center axis of rotation of the phaser and may also be parallel to the center axis of rotation. The phase control valve directs fluid flow to shift the relative angular position of the rotor relative to the housing. The phaser may be cam torque actuated, oil pressure actuated, or torsion assist.

The word "offset" meaning displaced from the center axis of rotation of the phaser.

DETAILED DESCRIPTION OF THE INVENTION

Figure 1:
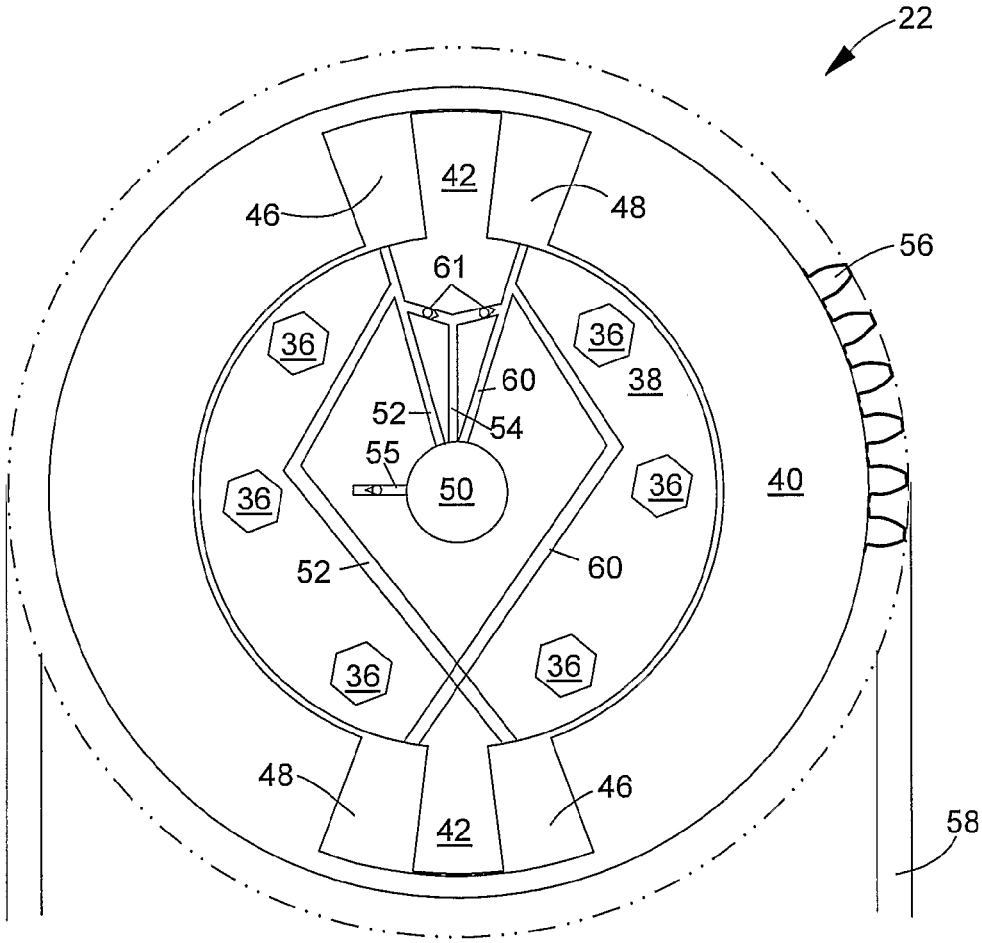
FIG. 1 PRIOR ART
FIG. 1 shows a schematic of a prior art variable cam timing system with a center mounted spool valve.

FIGS. 2-5*c* show a first embodiment of the present invention in a cam torque actuated phaser. Cam torque actuated (CTA) phasers use torque reversals in the camshaft 126, caused by the forces of opening and closing engine valves to move the vane 142. A control valve 168 is present to allow fluid flow from the retard chamber 148 to an advance chamber 146 or vice versa, causing the vane 142 to move. The advance and retard chambers 146, 148 are arranged to resist positive and negative torque pulses in the camshaft 126 and are alternatively pressurized by the cam torque. The CTA phaser has oil input to make up for losses due to leakage, but does not use engine oil pressure to move the phaser. CTA phasers have shown that they provide fast response and low oil usage, reducing fuel consumption and emissions.

The phaser 122 has a housing 144 with an outer circumference of teeth 156 for accepting drive force from a chain 158. The rotor 138 is connected to the camshaft 126 by centrally located bolt 166 and is coaxially located within the housing 144. The housing 144 and the front cover plate 103 of the phaser are bolted together by bolts 136. The rotor 138 has at least one vane 142, which separates a chamber formed between the housing 144 and the rotor 138 into the advance chamber 146 and the retard chamber 148. Seals 121 are present between the housing 144 and the rotor 138 to help control leakage. The vane 142 is capable of rotation to shift the relative angular position of the housing 144 and the rotor 138.

Figure 3:
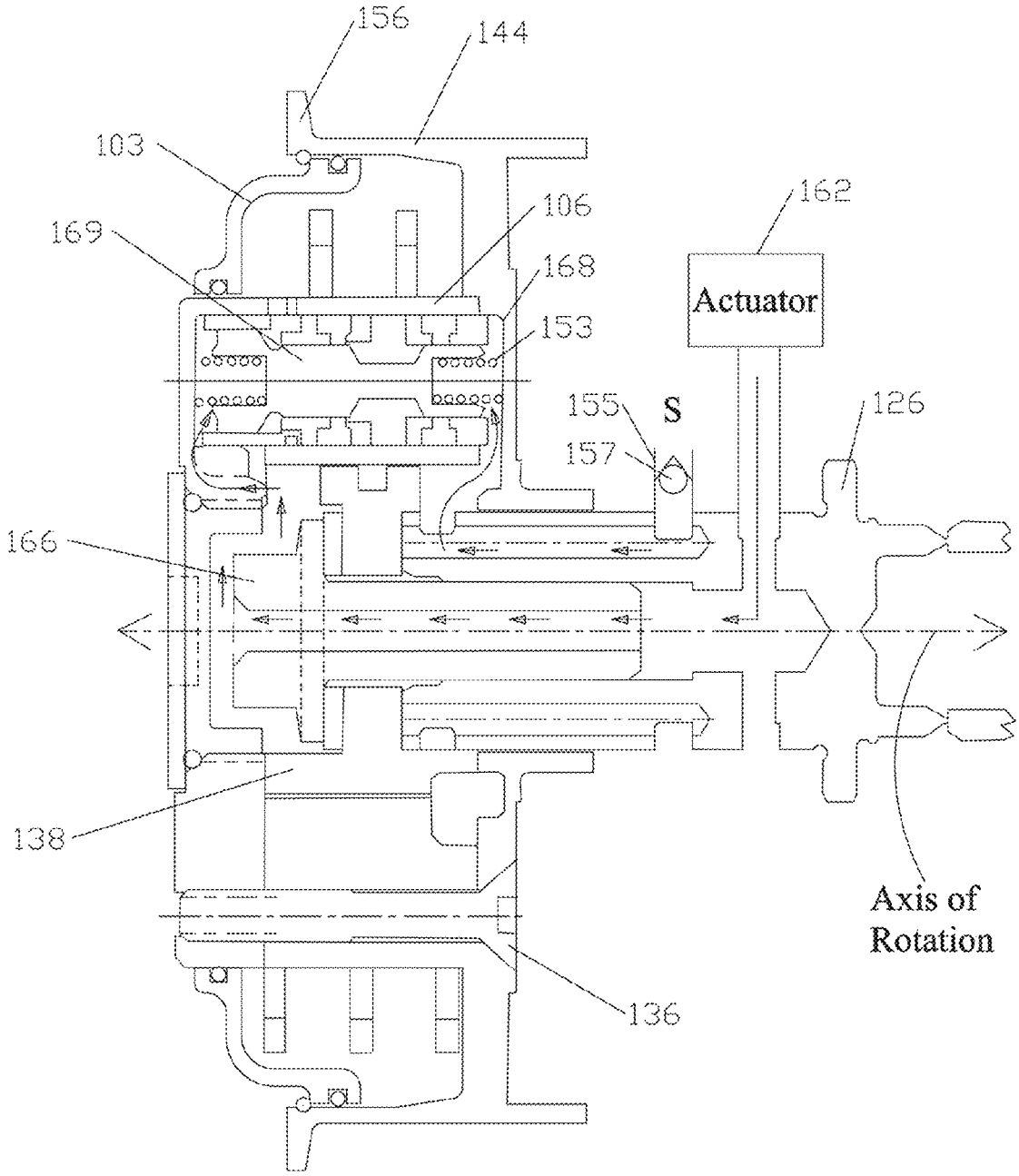
FIG. 3 shows a section through the offset spool valve along line 3-3 of FIG. 2.
Figure 4:
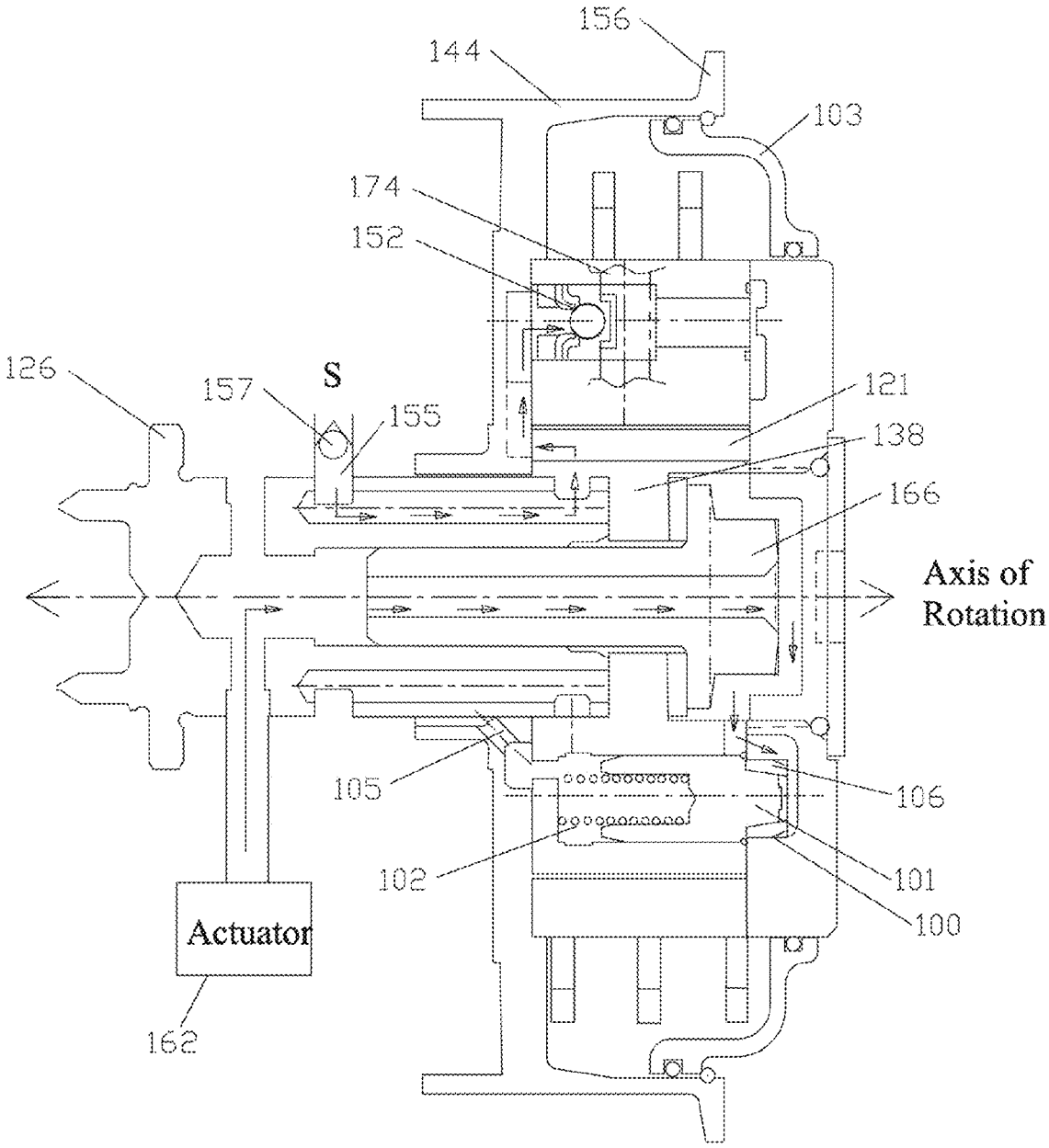
FIG. 4 shows a section through the inlet check valve and lock pin along line 4-4 of FIG. 2.

Fluid is supplied to the phaser 122 through supply line 155 leading to the control valve 168. Line 174 with check valves 151, 152, supply fluid to lines 170 and 178. Lines 170 and 178 route fluid between the advance and retard chambers 146, 148 and the internally mounted offset or off-center control valve or spool valve 168. The word "offset" and "off-center" meaning displaced from the center axis of rotation of the phaser, which would be through the center of camshaft 126 and is shown in FIGS. 3 and 4. In this embodiment the offset control valve 168 is also parallel to the axis of rotation of the phaser.

The control valve 168 includes a sleeve 106 in a bore in the housing 144 that slidably receives a spool 169 with lands 169*a*, 169*b*. One end of the spool 169 is biased in a first direction by spring 153 and the other end is biased in a second direction, opposite the first direction by an actuator 162, see FIGS. 5*a* through 5*c*. The position of the spool 169 within the control valve 168 controls the motion, (e.g. to move towards the advance position or the retard position) of the phaser. In a preferred embodiment, the actuator is hydraulic nature and is preferably a regulated pressure control system as disclosed in provisional application No. 60/676,771, filed May 2, 2005, entitled "TIMING PHASER CONTROL SYSTEM", which is hereby incorporated by reference or by a differential pressure control system as disclosed in Butterfield et al.'s U.S. Pat. No. 5,172,659, issued Dec. 22, 1992 entitled DIFFERENTIAL PRESSURE CONTROL SYSTEM FOR VARIABLE CAMSHAFT TIMING SYSTEM, which is hereby incorporated by reference. Alternatively, the other side of the spool may be biased by a pulse width modulated valve, a variable force solenoid, a second spring or an on/off solenoid.

Figure 5A:
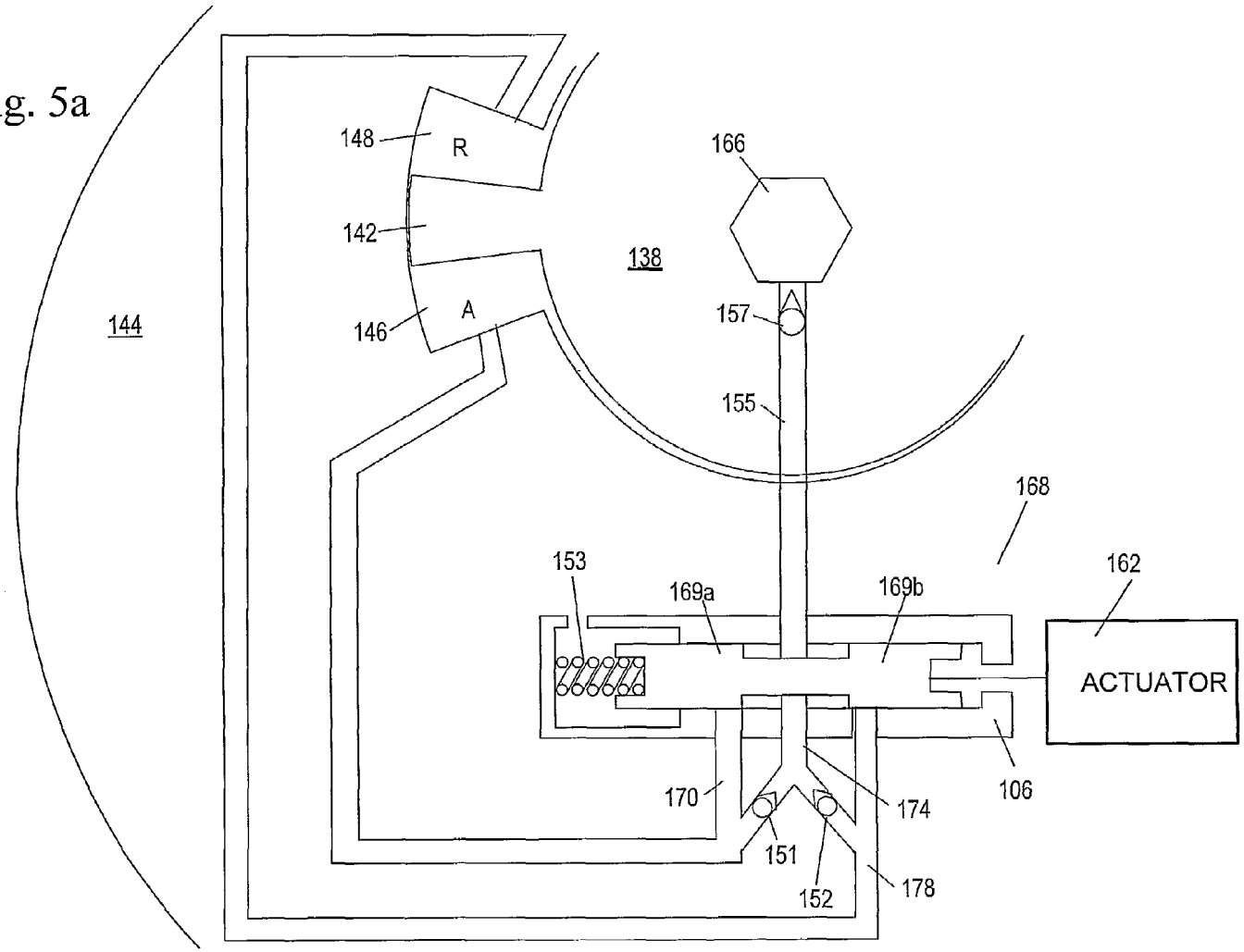
FIG. 5*a* shows another schematic of the cam torque actuated phaser of the first embodiment in the null position.

FIG. 5*a* shows the phaser in null or a central position where spool lands 169*a*, 169*b* block lines 170 and 178, respectively and vane 142 is locked into position. A small amount of fluid is provided to the phaser to make up for losses due to leakage.

Figure 5B:
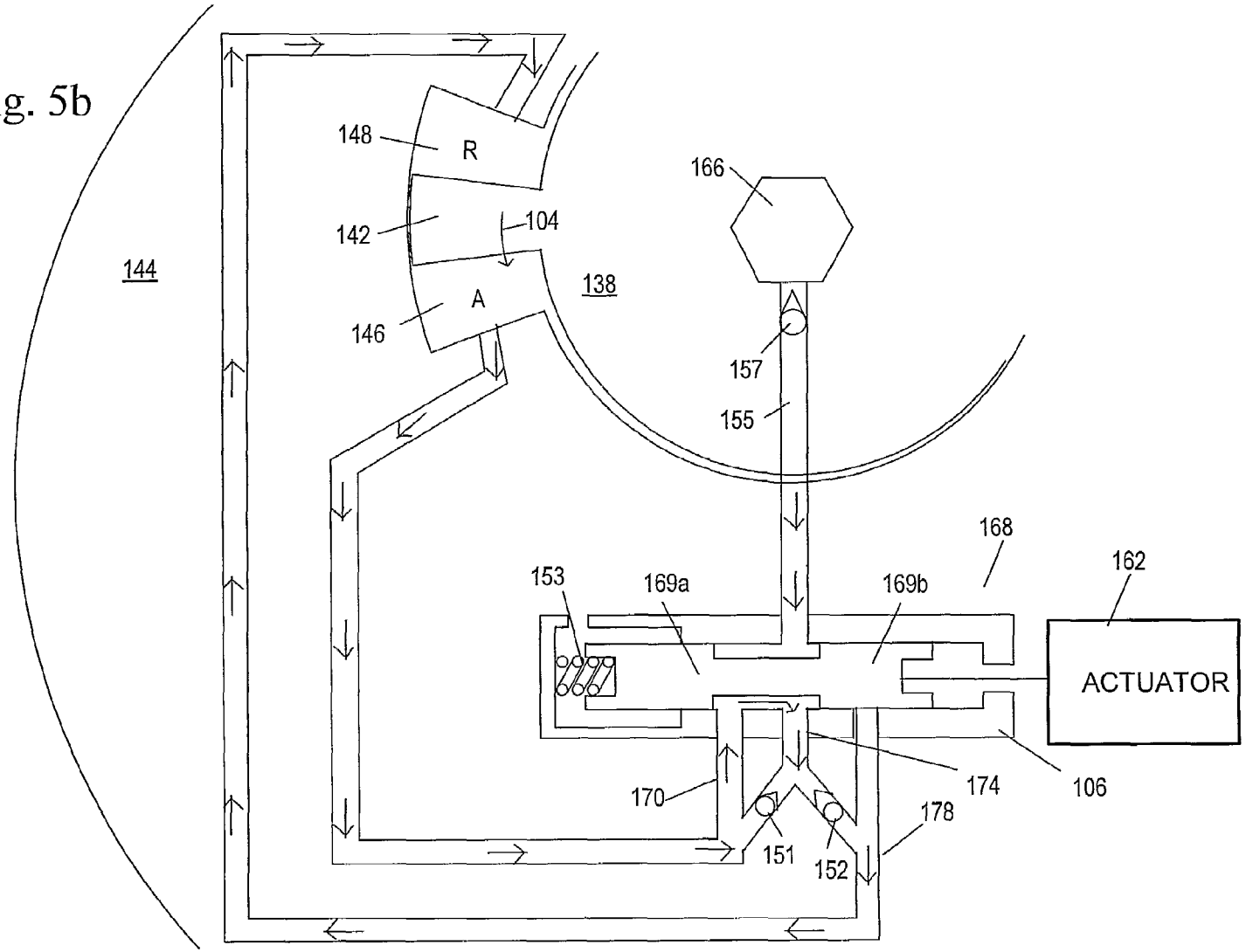
FIG. 5*b* shows a schematic of the cam torque actuated phaser of the first embodiment moving towards the retard position.

In moving towards the retard position, as shown in FIG. 5*b*, the force generated by the actuator 162 was increased and the spool 169 was moved to the left by actuator 162, until the force of the spring 153 balances the force generated by the actuator 162. Spool land 169*b* blocks line 178, and lines 170 and 174 are open. Camshaft torque pressurizes the advance chamber 146, causing fluid in the advance chamber 146 to move into the retard chamber 148. Fluid exiting the advance chamber 146 moves through line 170 and into the spool valve 168 between spool lands 169*a* and 169*b*. From the spool valve 168, fluid moves back into line 174 and open check valve 152, where it feeds into line 178, supplying fluid to the retard chamber 148 and moving the vane 142 in the direction shown by arrow 104.

Makeup oil is supplied to the phaser from supply S to make up for leakage and enters line 155 and moves through inlet check valve 157 to the spool valve 168. From the spool valve, fluid enters line 174 through either of the check valves 151, 152, depending on which is open to either the advance chamber 146 or the retard chamber 148.

Figure 5C:
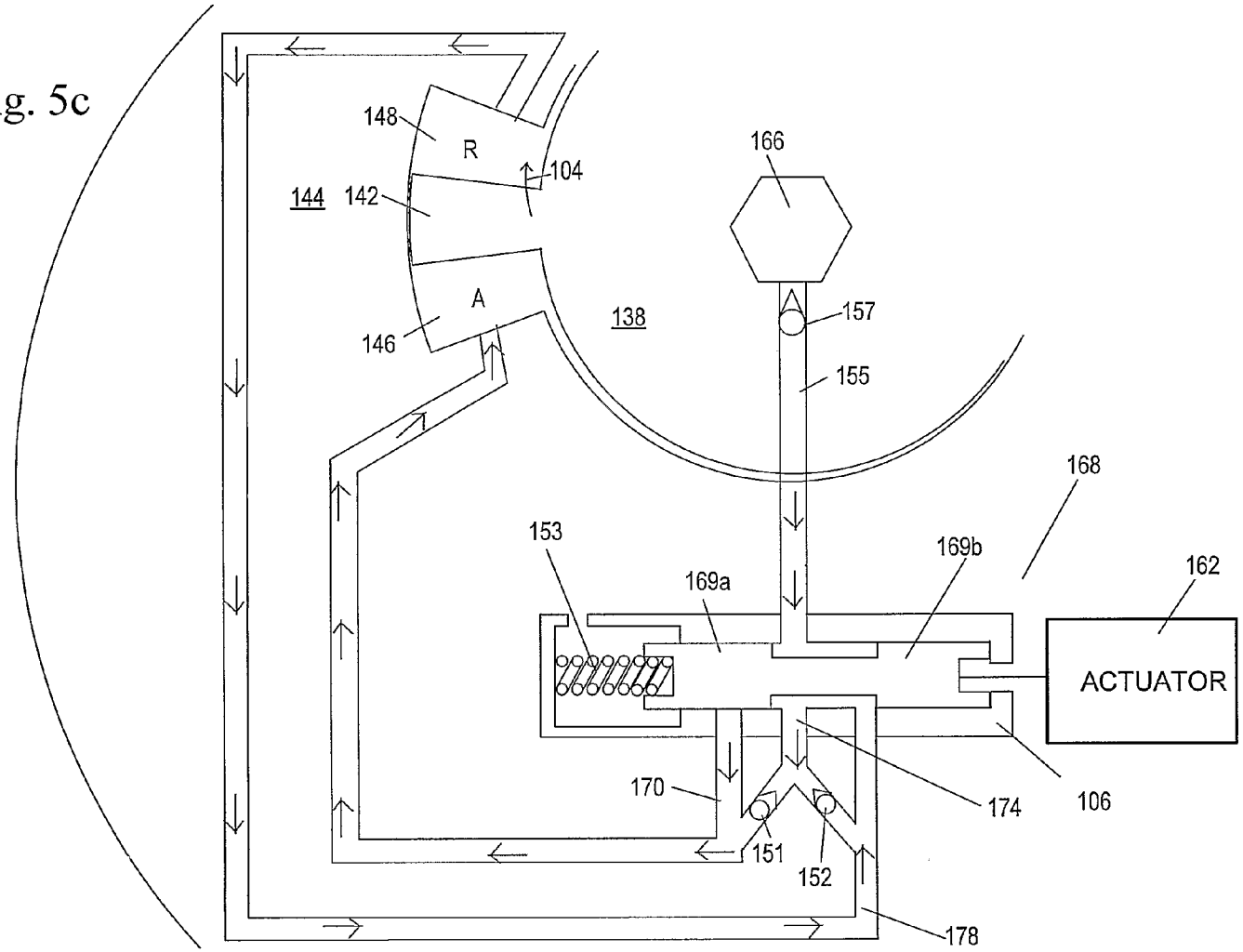
FIG. 5*c* shows a schematic of the cam torque actuated phaser of the first embodiment moving towards the advanced position.

To move towards the advance position, as shown in FIG. 5*c*, the force generated by the actuator 162 was decreased and the spool was moved to the right by force generated by the spring 153, until the force of the spring 153 balances the force of the actuator 162. In the position shown, spool land 169*a* blocks the exit of fluid from line 170, and lines 174 and 178 are open. Camshaft torque pressurizes the retard chamber 148, causing fluid in the retard chamber 148 to move into the advance chamber 146. Fluid exiting the retard chamber 148 moves through line 178 and into the spool valve 168 between lands 169*a* and 169*b*. From the spool valve 169, the fluid enters line 174 and travels through open check valve 151 into line 170 and the advance chamber 146 and moving the vane 142 in the direction shown by arrow 104.

Makeup oil is supplied to the phaser from supply S to make up for leakage and enters line 155 and moves through inlet check valve 157 to the spool valve 168. From the spool valve, fluid enters line 174 through either of the check valves 151, 152, depending on which is open to either the advance chamber 146 or the retard chamber 148.

Figure 2:
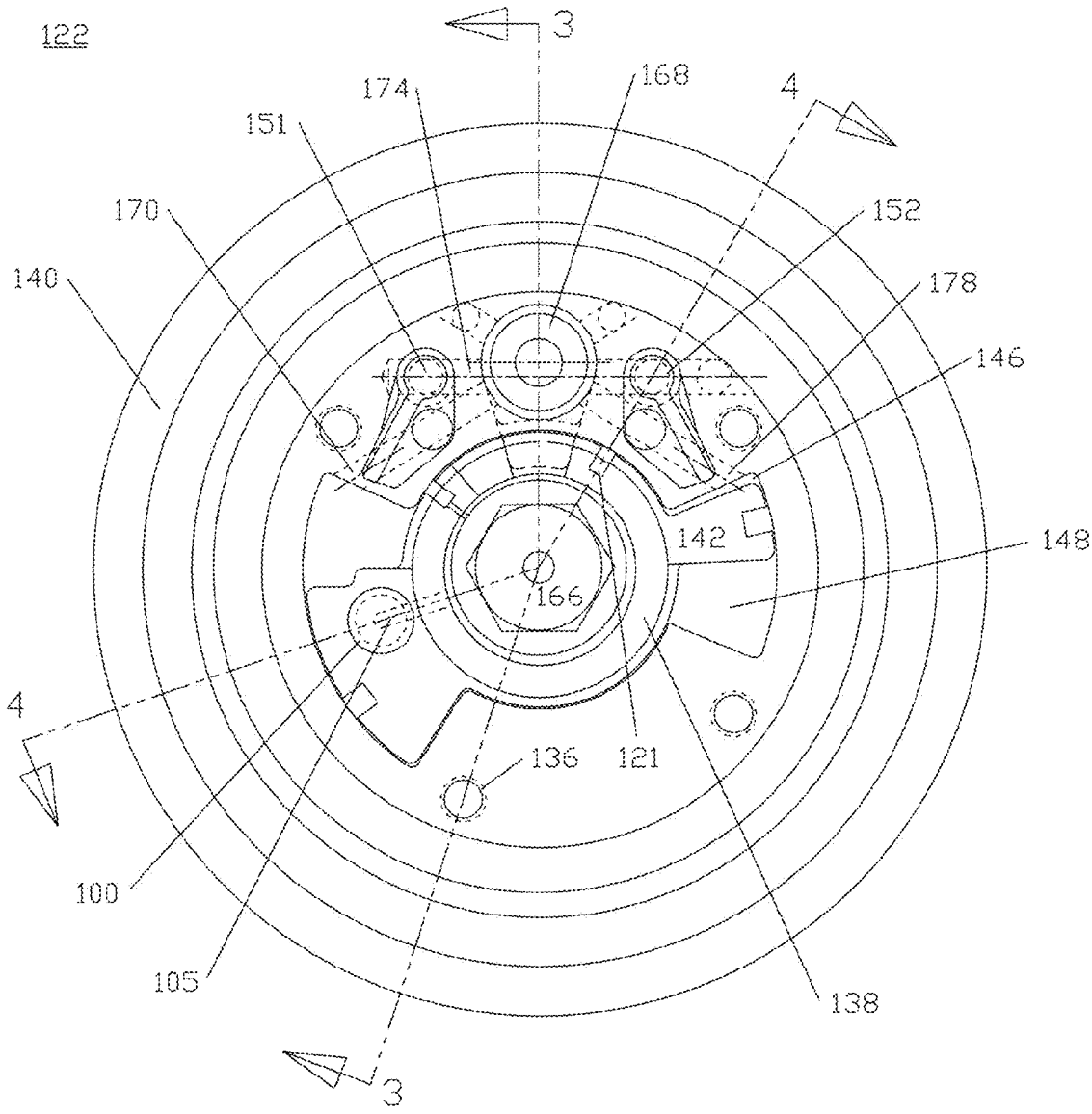
FIG. 2 shows a schematic of a variable cam timing (VCT) system of a first embodiment.

The phaser also preferably includes a locking pin 100, as shown in FIGS. 2 and 4, slidably located in a radial bore in the vane 142. The locking pin 100 has a body with a diameter adapted for a fluid-tight fit in the radial bore and a spring 102 biasing the locking pin 100 to a locked position. The locking pin 100 is biased to an unlocked position when the pressure of the fluid from the actuator 162, which in this embodiment is preferably hydraulic in nature, travels through the bolt 166 to line 106 in front of the locking pin, is greater than the force of spring 102. The locking pin 100 is locked when the pressure of the fluid from the actuator 162, which travels through bolt 166 to line 106 in front of the locking pin, is less than the force of spring 102 biasing the body 101 of the locking pin. In moving toward the retard position, the pressure of fluid in line 106 is not greater than the force of the locking pin spring 102, and the pin is moved to a locked position. In moving toward the advance position, and in the null position, the pressure of fluid in line 106 is greater than the force of the spring 102 and the locking pin is moved to an unlocked position. A vent 105 is present to allow any fluid in the chamber between the spring 102 and the locking pin 100 to escape.

Figure 6A:
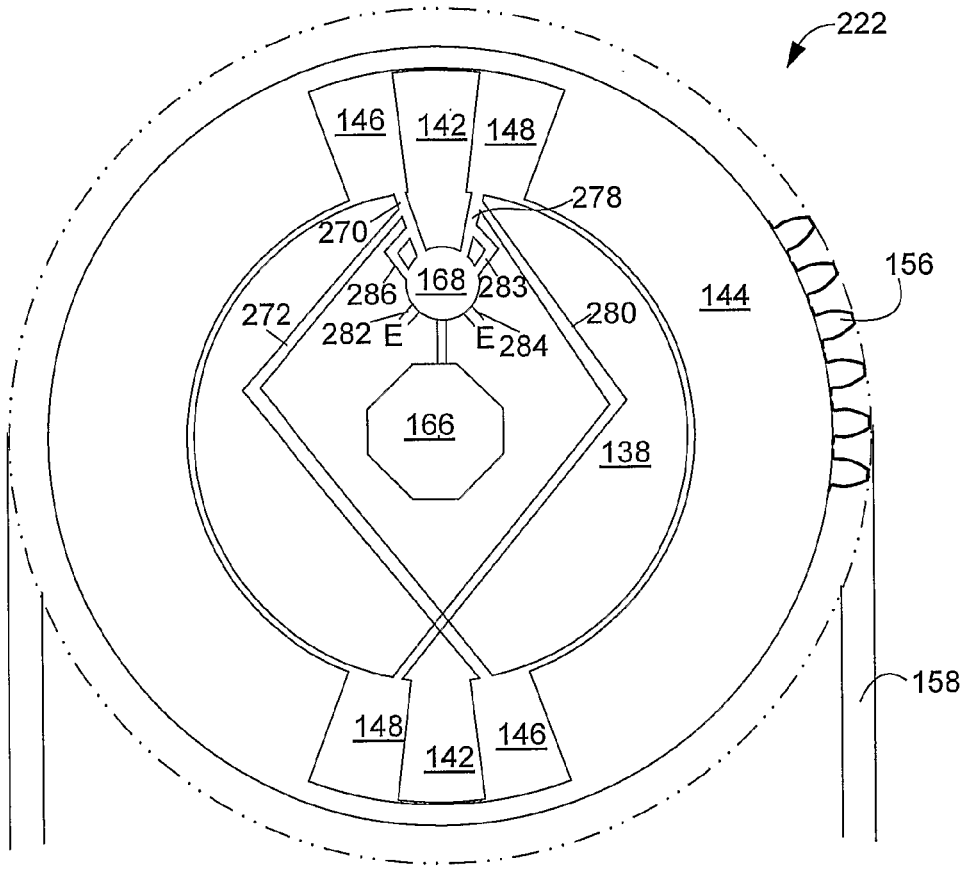
FIG. 6*a* shows a schematic of an oil pressure actuated variable cam timing phaser with an offset spool valve of a second embodiment in the null position.
Figure 6B:
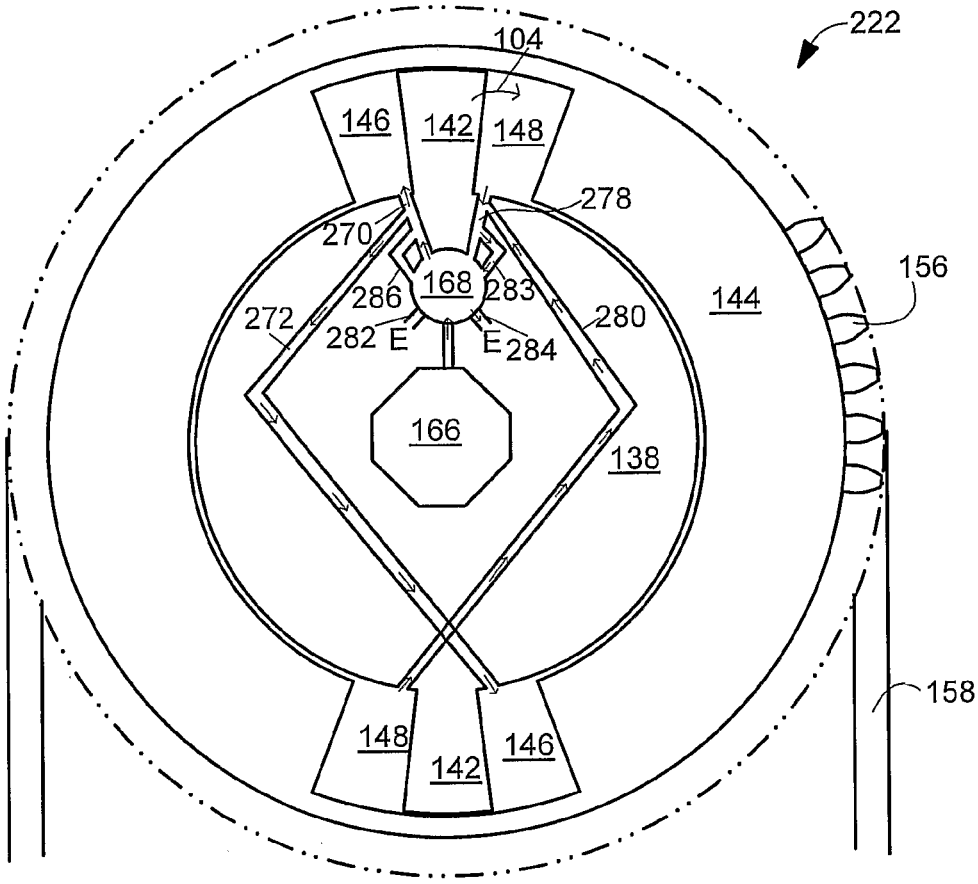
FIG. 6*b* shows a schematic of an oil pressure actuated variable cam timing phaser with an offset spool valve of a second embodiment moving towards an advance position.
Figure 6C:
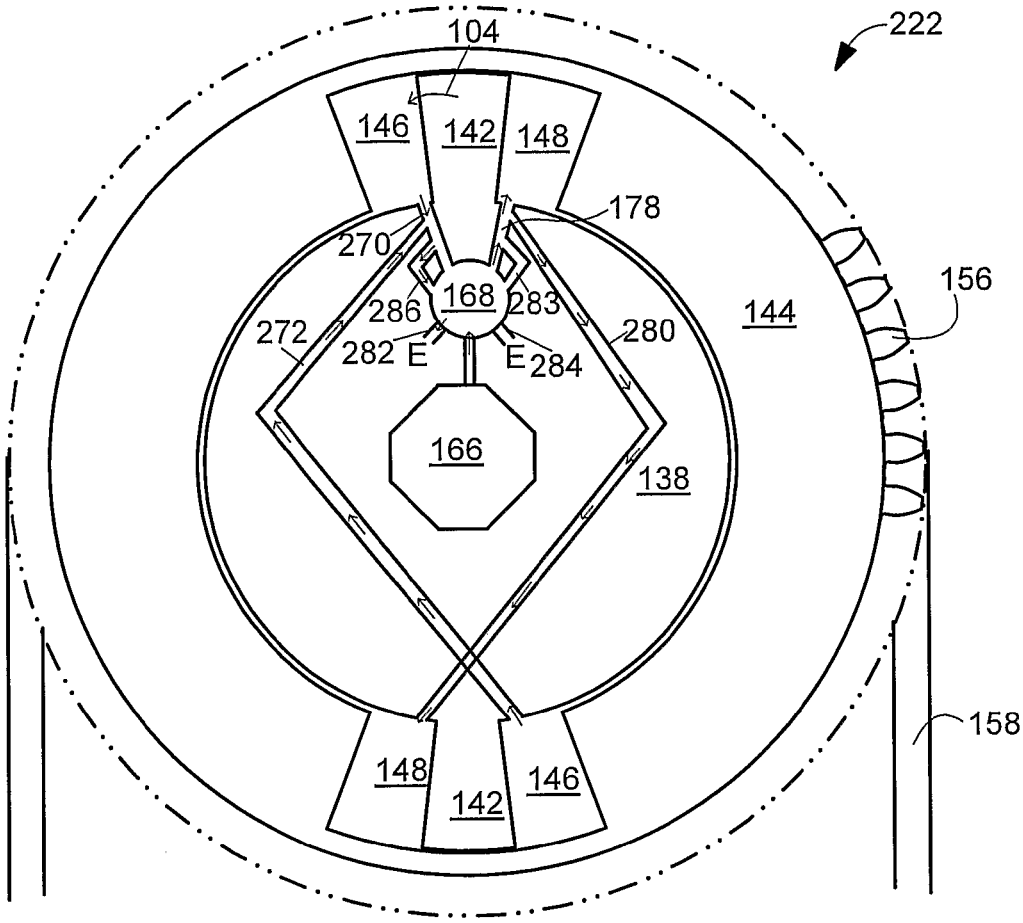
FIG. 6*c* shows a schematic of an oil pressure actuated variable cam timing phaser with an offset spool valve of a second embodiment moving towards an retard position.

FIGS. 6*a* through 6*c* schematically illustrates a second embodiment an oil pressure actuated phaser 222 with an offset spool valve 168. In an oil pressure actuated system, the spool valve 168 has a spool with lands (not shown) that selectively allow engine oil pressure from the supply to flow to either the advance chambers 146 or the retard chambers 148 via supply lines 270, 278, depending on the position of the spool valve 168. Oil from the opposing chamber 146, 148 is exhausted back through lines 286, 283 to the engine sump via either advance exhaust line 282 or retard exhaust line 284.

FIG. 6*a* shows the oil pressure actuated phaser is in the null position, where spool lands block lines 270, 286, 283, 278, 272, 280 and exhaust lines 282, 284 from receiving fluid, locking the vane 142 in position. A small amount of fluid is provided to the phaser to make up for losses due to leakage.

To move towards the advance position, as shown in FIG. 6*b*, the spool in the offset spool valve 168 is moved to a position such that the advance exhaust line 282 is blocked, lines 270, 272 are open to source, and lines 278, 280, 283, and 284 are open to exhaust fluid back to sump. Fluid is exhausted from the retard chambers 148 through lines 278, 280, 283 to retard exhaust line 284 back to sump, moving the vane 142 in the direction shown by arrow 104.

To move towards the retard position, as shown in FIG. 6*c*, the spool in the offset spool valve 168 is moved to a position such that the retard exhaust line 284 is blocked, lines 278 and 280 are open to source from line 155 and lines 270, 272, 282, 286 are open to exhaust fluid back to sump. Fluid is exhausted from the advance chambers 148 through lines 270, 272, and 286 to retard exhaust line 282 back to sump, moving the vane 142 in the direction shown by arrow 104.

Figure 7:
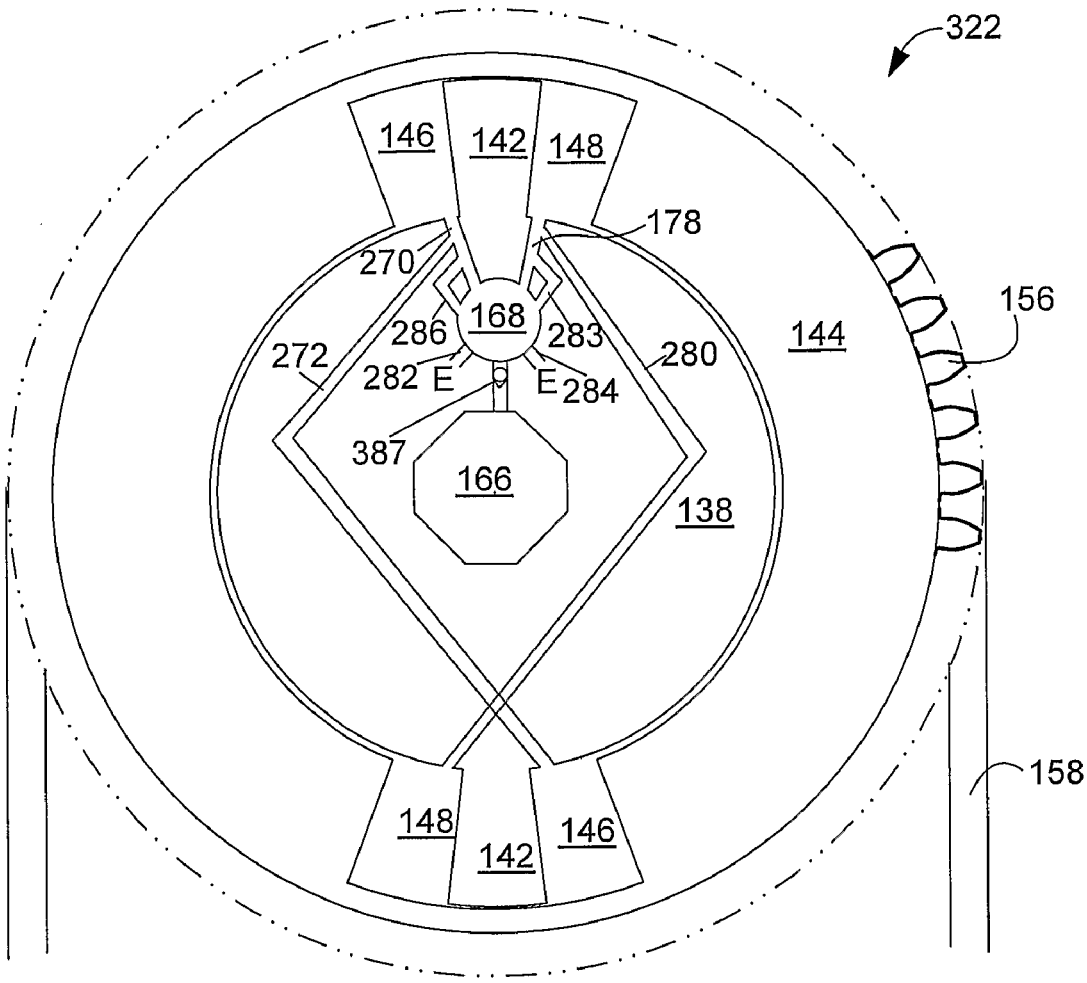
FIG. 7 shows a schematic of a torsion assist variable cam timing phaser with an offset spool valve of a third embodiment.

FIG. 7 schematically illustrates a third embodiment in which a torsion assist phaser 322 has an offset spool valve 168. The torsion assist phaser includes a check valve 387 in supply line 155, or check valves in lines 270, 278 to each chamber (not shown). U.S. Pat. No. 6,883,481, issued Apr. 26, 2005, entitled "Torsional Assisted Multi-Position Cam Indexer Having Controls Located in Rotor" discloses a single check valve TA, and is herein incorporated by reference and U.S. Pat. No. 6,763,791, issued Jul. 20, 2004, entitled "Cam Phaser for Engines Having Two Check Valves in Rotor Between Chambers and Spool Valve" discloses two check valve TA, and is herein incorporated by reference. The check valve 387 blocks oil pressure pulses due to torque reversals, caused by changing load conditions, from propagating back into the oil system, preventing drainage of oil from the phaser when the engine is stopped, and stopping the vane from moving backwards due to torque reversals. Forward torque effects aid in moving the vane. Aside from the prevention of oil propagating back into the oil system from torque reversals, the torsion assisted phaser 322 operates in a similar fashion to the oil pressure activated system of FIGS. 6*a* through 6*c* and the description is repeated here by reference.

Figure 8:
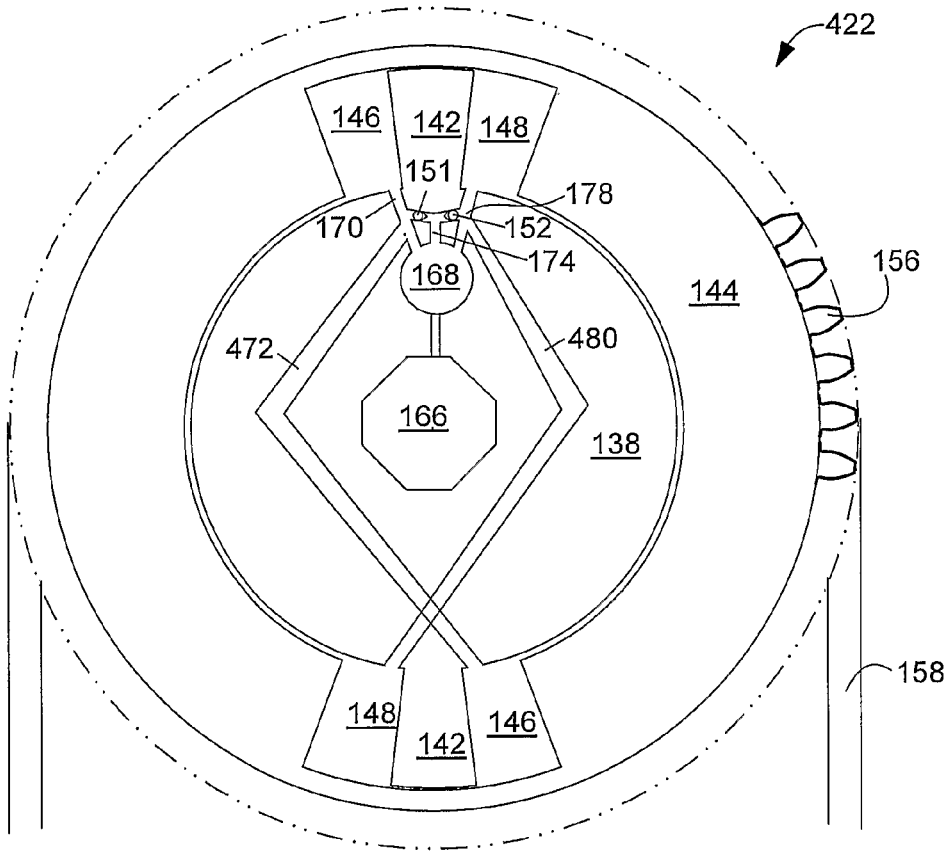
FIG. 8 shows a schematic of a cam torque actuated variable cam timing phaser with an offset spool valve of a fourth embodiment.

FIG. 8 shows a cam torque actuated phaser 422 of a fourth embodiment with an offset spool valve 168 similar to the phaser shown in FIGS. 2 through 5*c*. By having the spool valve 168 offset in the phaser the length of the lines connecting the spool valve 168 to chambers 146, 148 may be different in length. For example, lines 170 and 178 are different in length then lines 472 and 480. To compensate for the increased restriction on some longer fluid lines, such as lines 472, 480 the lines may be made larger. Longer advance fluid line 472 is larger in cross-section than shorter advance fluid line 170. Similarly, longer retard fluid line 480 is larger in cross-section than shorter retard fluid line 178. While the larger cross-section lines 472, 480 are shown in a cam torque actuated phaser, they may also be used to compensate for the long length of lines in oil pressure actuated phasers and in torsion assist phasers.

Figure 9:
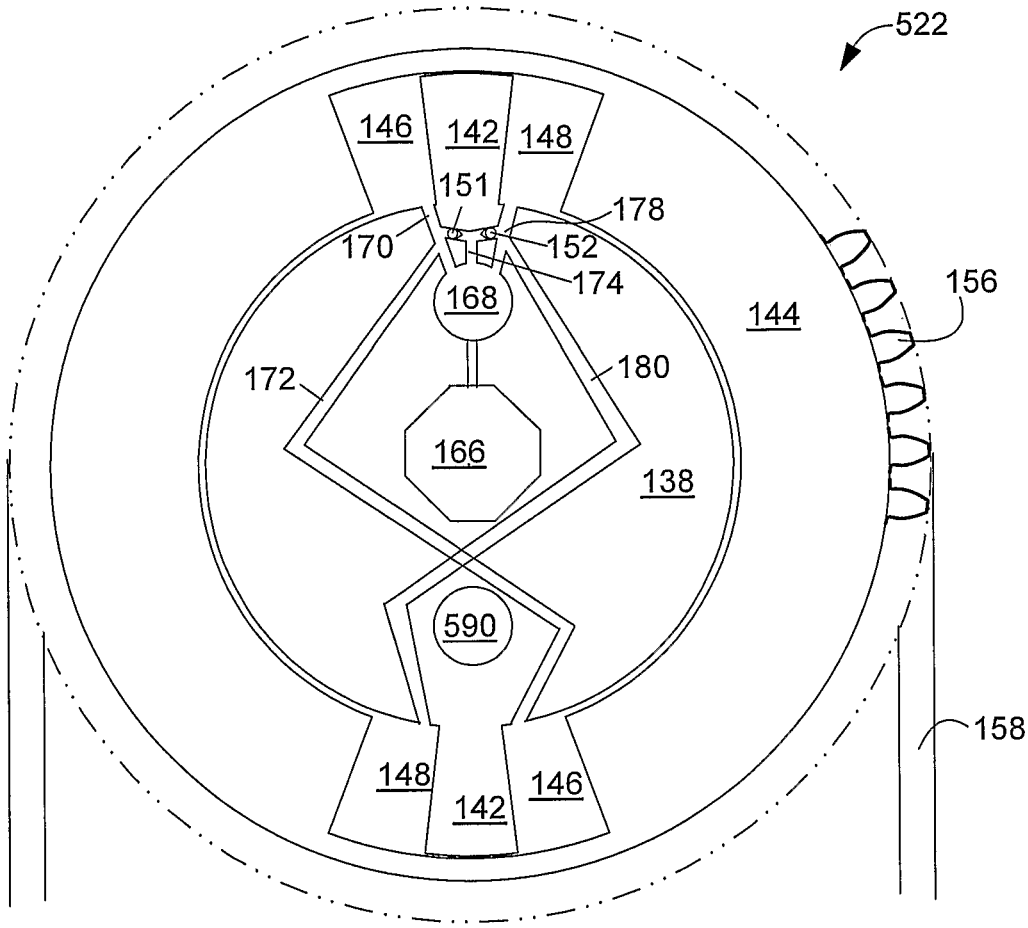
FIG. 9 shows a schematic of a cam torque actuated variable cam timing phaser with an offset spool valve of a fifth embodiment.

FIG. 9 shows a fifth embodiment in which a portion of a cam torque actuated phaser 522 is removed to accommodate a balance area 590. The size and shape of the balance area 590 may be selected to account for a spool valve 168, which is lighter than the rotor 138 material the spool valve 168 replaces. Alternatively, if the spool valve 168 is heavier than the material in the rotor 138 which the spool valve 168 replaces, then the balance area 590 may be filled with a more dense material to help balance the VCT phaser. If the VCT were to become unbalanced, load variation may be introduced into the system and can cause increased wear on the parts driving the phaser. The balance area 590 may also be used with a torsion assist phaser or an oil pressure actuated phaser.

Figure 10:
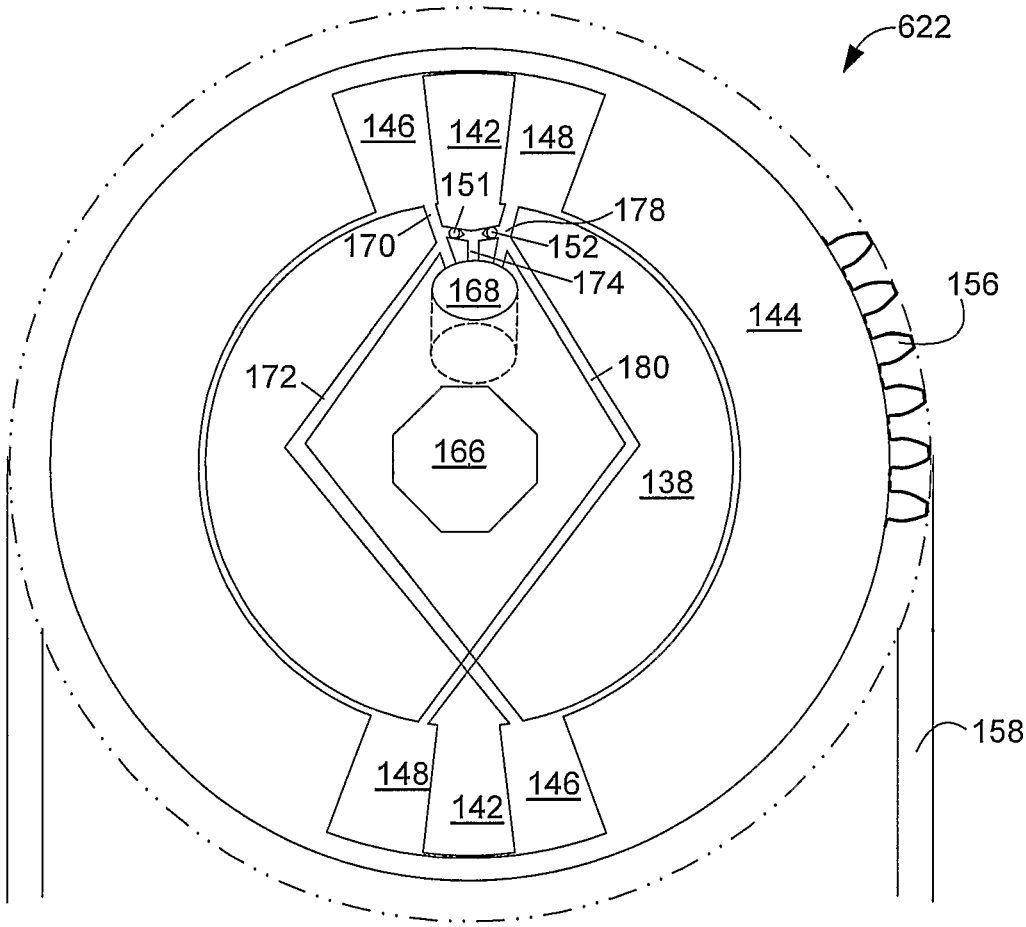
FIG. 10 shows a schematic of a cam torque actuated variable cam timing phaser with an offset spool valve of a sixth embodiment.

FIG. 10 shows a sixth embodiment in which the offset spool valve 168 is installed offset from the center axis of rotation through the camshaft and along an axis which it not parallel to the axis of rotation of the phaser 622. It should be noted that while the offset spool valve of this embodiment is shown in a cam torque actuated phaser, it may also be used in a torsion assist phaser and an oil pressure actuated phaser.

Figure 11:
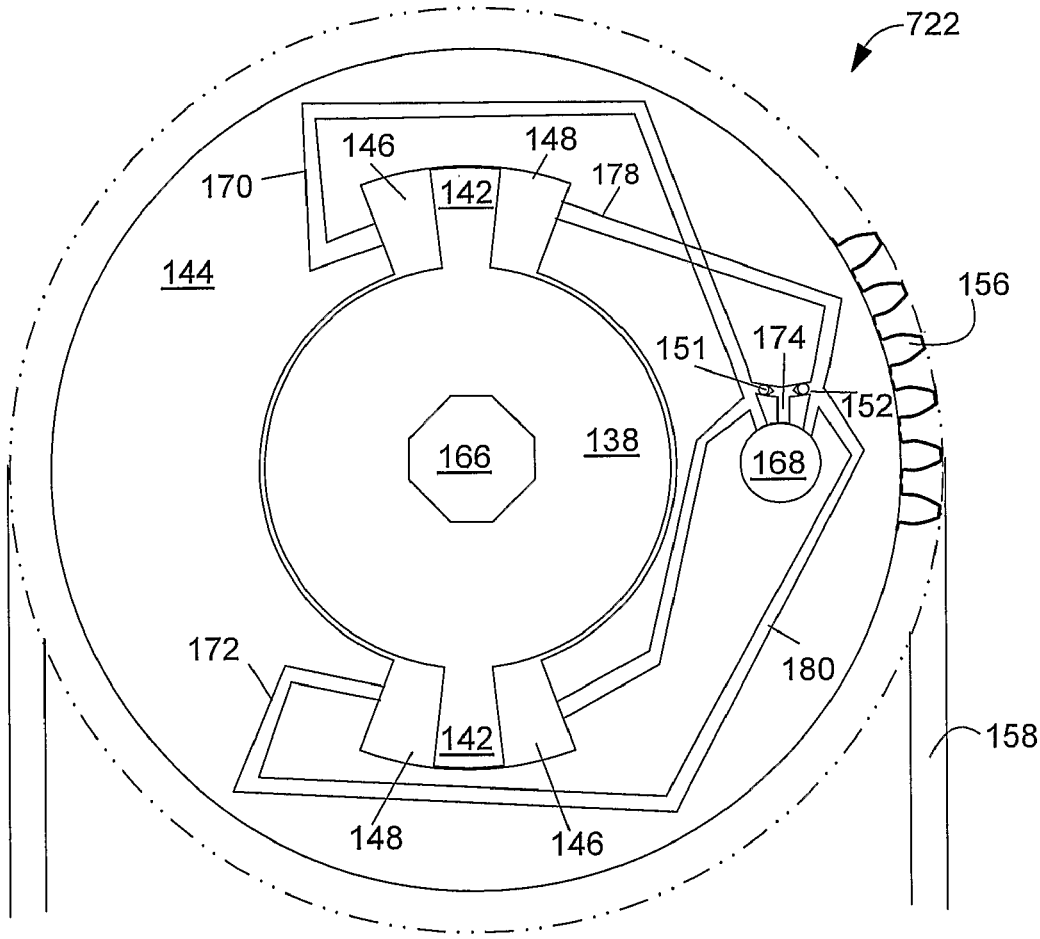
FIG. 11 shows a cam torque actuated phaser with a spool valve mounted offset from the center line of the phaser in the housing of a seventh embodiment.

FIG. 11 shows a seventh embodiment in which the spool valve 168 has been moved out of the rotor 138 and into the housing 144. The phaser 722 of this embodiment operates in a similar fashion to the phaser of FIG. 2 through 5*c*. Experiments and modeling have shown that the centrifugal forces on an offset spool valve, even if offset into the housing, is low enough compared to the operating oil pressures that the spool valve will be operable (moveable). In any of the embodiments, if the centrifugal force becomes too, high, the concern would be that the valve would have trouble moving due to an increased coefficient of friction. To offset this effect, the spool valves may optionally be made from lighter materials, and/or the spool valves may be made smaller. Again, while the offset spool valve is shown in the housing in a cam torque actuated phaser, the spool may also be present in the housing of an oil pressure actuated phaser and a torsion assist phaser.

The offset spool valve 168 is not limited to the arrangement, shape, or number of lands shown in the figures. The actuator 162 may be hydraulic, electric, differential pressure control system, regulated pressure control system, or a variable force solenoid.

In all of the above embodiments, the words "offset" and "off-center" mean displaced from the center axis of rotation of the phaser which runs through the center of the camshaft 126 and is shown in FIGS. 3 and 4.

The placement of the spool valve 168 off-center or offset from the center axis of rotation is counter-intuitive to common design considerations because of side-loading concerns on the spool valve 168 from centrifugal forces. However, by locating the spool valve 168 offset from the center axis of rotation of the phaser, a single bolt 166 may be used to connect the phaser to the camshaft 126. Many automobile manufacturers are used to dealing with a single-bolt VCT phaser which can be easier to install. These prior art phasers, however, had the spool valve located remotely from the phaser, not offset on the phaser, and therefore had longer oil paths, more restriction, and were subject to more leaks. The embodiment of FIGS. 2 through 11 mounts the spool valve 168 internal, but offsets it to accommodate an easier one-bolt installation onto the camshaft 126, as well as maintaining the advantages of shorter oil paths, less leakage, and less restriction.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine with at least one camshaft comprising:

a housing with an outer circumference for accepting a drive force;

a rotor for connection to a camshaft coaxially located within the housing having at least one vane defining a chamber between the housing and the rotor, the at least one vane separating the chamber into an advance chamber and a retard chamber, the at least one vane being capable of rotation to shift relative angular position of the housing and the rotor; and a phase control valve in the housing or the rotor of the phaser and offset from a center axis of rotation through the camshaft of the phaser, for directing fluid flow to shift the relative angular position of the rotor relative to the housing.

2. The variable cam timing phaser of claim 1, wherein the phase control valve is parallel to the center axis of rotation of the phaser.

3. The variable cam timing phaser of claim 1, wherein the phaser control valve is a spool valve having a spool with a first end and a second end slidably received in a bore of the housing, wherein the first end of the spool is biased by a spring in a first direction and the second end of the spool is biased in a second direction by an actuator.

4. The variable cam timing phaser of claim 3, wherein the actuator is a regulated pressure control system or a differential pressure control system.

5. The variable cam timing phaser of claim 3, wherein the actuator is a pulse width modulated valve, a variable force solenoid, a second spring or an on/off solenoid.

6. The variable cam timing phaser of claim 1, wherein the phase control valve routes fluid from a pressurized fluid source to the advance chamber or the retard chambers and exhausts fluid from the other advance chamber or retard chamber.

7. The variable cam timing phaser of claim 6, wherein fluid is routed through a plurality of passages.

8. The variable cam timing phaser of claim 7, wherein at least two of the plurality of passages are larger in cross-section and length than the plurality of the passages.

9. The variable cam timing phaser of claim 6, further comprising a check valve between the phase control valve and the pressurized fluid source.

10. The variable cam timing phaser of claim 1, wherein the phase control valve controls phaser position by selectively directing fluid from the advance chamber to the retard chamber and blocking reverse fluid flow.

11. The variable cam timing phaser of claim 10, further comprising a passage connected to a pressurized fluid source for supplying makeup fluid to the advance chamber and the retard chamber.

12. The variable cam timing phaser of claim 11, wherein the passage further comprises a check valve.

13. The variable cam timing phaser of claim 1, further comprising a makeup line between the phase control valve and a pressurized fluid source for providing makeup fluid to the phaser.

14. The variable cam timing phaser of claim 1, farther comprising a balance area in alignment with the phase control valve.

* * * * *